United States Patent [19]

Roberts et al.

[11] Patent Number: 4,949,736

[45] Date of Patent: Aug. 21, 1990

[54] VARIABLE VENTILATION MOUTHPIECE FOR A SMOKING ARTICLE

[75] Inventors: Donald L. Roberts; David W. Boldridge, both of Winston-Salem, N.C.

[73] Assignee: R. J. Reynolds Tobacco Company, Winston-Salem, N.C.

[21] Appl. No.: 168,730

[22] Filed: Mar. 16, 1988

[51] Int. Cl.[5] ..... A24D 3/04

[52] U.S. Cl. ..... 131/336; 131/198.1; 131/198.2

[58] Field of Search ..... 131/336, 198.1, 198.2, 131/338, 339, 340

[56] References Cited

U.S. PATENT DOCUMENTS 3,359,988 12/1967 Thomson .
3,503,406 3/1970 Riegel et al. .
3,695,274 10/1972 Summers .
4,119,105 10/1978 Owens, Jr. .
4,532,943 8/1985 Nichols et al. .
4,559,955 12/1985 Brockway et al. .
4,576,187 3/1986 Deal .
4,582,073 4/1986 Simkanich .
4,620,553 11/1986 Bale et al. ..... 131/198.1
4,638,820 1/1987 Roberts et al. ..... 131/338
4,648,413 3/1987 Saintsing et al. .
4,649,945 3/1987 Norman et al. .
4,702,263 10/1987 Strydom .

FOREIGN PATENT DOCUMENTS 2130862 12/1972 Fed. Rep. of Germany .
1491179 11/1977 United Kingdom .

*Primary Examiner*—V. Millin

[57] ABSTRACT

A variable ventilation mouthpiece for a smoking article includes first and second sets of vents, the first set serving to admit ambient air into the mouthpiece, and the second set adapted to variably introduce the admitted air into the smokestream for varying the level for dilution of the smokestream in relation to the suction applied by the smoker to the mouthpiece.

7 Claims, 1 Drawing Sheet

VARIABLE VENTILATION MOUTHPIECE FOR A SMOKING ARTICLE

FIELD OF THE INVENTION

The present invention relates generally to smoking articles, and more particularly to smoke control devices for cigarettes and other smoking articles by which the ventilation level of the smokestream is varied at will by the smoker.

DESCRIPTION OF THE PRIOR ART

In the past, various devices have been developed in the form of filters, valves and other mechanisms principally for use in cigarettes or cigarette holders, but also usable in other smoking articles, by which to change the flow characteristics of the smokestream from that of an unfiltered smoking article when the smoker draws on the article. In the unfiltered smoking article, of course, the smoke is filtered naturally by the tobacco itself. In that respect, the terms "filtered" and "unfiltered," as used herein, refer to the presence or absence, respectively, of a non-tobacco or other smoking material device in the smokestream of the smoking article for the purpose of affecting the characteristics of the smokestream. Further, it will be understood that although the term "cigarette" is used frequently in the descriptive portion of this document, the description may apply equally well to other smoking articles.

Perhaps the most common form of cigarette filter is that in which a filtering rod, of fibrous material such as cellulose acetate, for example, is positioned abutting the tobacco rod, the latter being wrapped in cigarette paper, and the filter being wrapped in perforated tipping paper to form the mouthpiece of the cigarette. The purpose of the perforations is to allow ventilating air to enter the smokestream, and thereby dilute or reduce the concentration of smoke in the stream, as the smoker draws on the cigarette. This reduction in delivery of smoke reduces the delivery of particulate matter and nicotine, for a given draw. It will be apparent that the more ventilating air which enters the smokestream, the smaller the concentration of smoke drawn through the filter, with a concomitant reduction in flavor to the smoker. Each draw is characterized as a puff, and different smokers have their own perception of what constitutes a normal puff, based on the length and depth of their particular draw.

Modifications of the perforated tip and additional techniques by which to increase or otherwise vary the amount of ventilating air introduced into the flow delivered to the smoker with each puff are found in the prior art. For example, U.S. Pat. No. 3,359,988 to Thompson and U.S. Pat. No. 3,503,406 to Regal et al disclose cigarette structures with perforated external sleeves adapted to be slidably positioned for greater or lesser alignment with perforations in the filter mouthpiece to respectively increase or decrease the introduction of ventilating air per puff.

U.S. Pat. No. 3,695,274 to Summers describes the use of a cup-like piston in the mouthpiece of the cigarette, the piston being adapted to slide within the mouthpiece as the density of smoke drawn through holes in its face is increased, thereby aligning other openings in the cylindrical wall of the piston with the perforations in the outer wrap of the filter mouthpiece and allowing the introduction of ventilating air into the stream. A variation of the Summers patent is found in German Offenlegungsschrift No. 21 30 862 of Keller and U.S. Pat. No. 4,559,955 to Brockway et al in which valving is arranged in a cigarette mouthpiece or holder to provide an initial phase of substantially smoke-free air followed by a secondary phase of a substantially undiluted smokestream in each puff.

In U.S. Pat. No. 4,638,820 to Roberts et al, assigned to the assignee of the present invention, the cigarette is provided with valve and ventilation means in or adjacent to the filter section to provide a higher concentration of smoke during the first portion of the puff and a lower concentration of smoke during the remainder of the puff.

In U.S. Pat. No. 4,649,945 to Norman et al, also assigned to the assignee of the present invention, the cigarette has an adjustable delivery air dilution while at the same time exhibits a reduced pressure drop decrease during air dilution. The pressure drop decrease is controlled by positioning the air dilution means for greatest air dilution at a greater distance from the draw end than the air dilution means for the least air dilution.

A technique for controlling the quantity of smoke delivered with each puff without the use of perforations in the filter mouthpiece or overwrap is described in U.S. Pat. No. 4,119,105 to Owens, Jr. According to the latter, the cigarette includes a valve in the form of a resilient flap between the tobacco rod and the filter tip, which closes or opens according to the magnitude of the pressure drop across it. The heavier the draw by the smoker, the faster the flap closes, so that each puff is limited to a predetermined yield of smoke regardless of the length and depth of the draw.

Other proposals which permit the smoker to regulate the concentration of smoke delivered with each draw by physically modifying the structure of the cigarette or the characteristics of the draw itself are disclosed in U.S. Pat. No. 4,648,413 to Saintsing et al and British Pat. No. 1,491,179 to Ponsy. In the former, the cigarette includes an "adjustment zone" in the form of a slot in the filter overwrap which, upon bending of the tip by the smoker, ruptures the cigarette paper exposed in the slot and thereby allows ventilating air to be introduced to dilute the smokestream with each puff. In the aforementioned British patent, the cigarette holder or filter is provided with a smoke passageway in which a flexible circular membrane is centrally fastened, and its outer unfastened edge is normally in contact with the inner wall of the passageway to close the latter, the membrane deflecting toward the filter outlet in response to the vacuum created in the passageway when the smoker draws on the cigarette, to allow smoke to pass through the annular opening thereby formed between the membrane outer edge and the inner wall of the passageway. Accordingly, the amount of smoke delivered increases with the depth and length of the draw.

U.S. Pat. No. 4,542,943 to Nichols et al discloses an adjustable delivery cigarette with a filter plug comprising a first mouth-end segment of filter tow axially connected to a second rod-end segment of filter tow for rotation about the axis of the cigarette. In addition, it is disclosed that passages in the first and second segments can be in varying degrees of registry upon rotation of the aforementioned segments in order to vary the resistance to draw of the cigarette. Such an adjustable delivery cigarette having a variable resistance to draw would appear to provide a change in resistance to draw only upon essentially complete misalignment of the passages.

Thus, it is expected that the cigarettes would exhibit numerous air dilution settings while having essentially only two resistance to draw settings. In addition, it would appear that an adjustable delivery cigarette having a variable resistance to draw is difficult to manufacture as the passages would have to be formed, misaligned (i.e., into the high resistance to draw setting) when the high air dilution opening is provided, and realigned into the low air dilution setting (and low resistance to draw setting) for packaging.

U.S. Pat. No. 4,702,263 to Strydom discloses a filter cigarette with a valve insert interposed between the tobacco rod and the filter and overwrapped with perforated tipping paper. The insert has an axial bore through which smoke passes from the tobacco rod to the filter and radial orifices in the axial bore with loose rings overlying the radial orifices so that when flow through the perforated tipping paper and orifices exceeds a predetermined value, the rings block flow through the orifices.

Previous techniques and devices for adjusting the amount of full-flavor smoke delivered to the smoker of the cigarette, or the dilution of the smokestream with ventilating air, are generally characterized by cumbersome or complex arrangements which increase the cost of manufacture of the cigarette and, thus, the price to the consumer, in some instances without a concomitant improvement in smoking satisfaction, or reduction of particulate matter and nicotine.

SUMMARY OF THE INVENTION

It is a principal object of the present invention to provide improvements in the configuration of smoking articles in general, and cigarettes in particular, which may be implemented at relatively low cost in the manufacturing process, and which allow the smoker to control at will the concentration of full-flavor smoke delivered with each puff.

According to the present invention, a smoking article is provided comprising, in combination, a smoke producing material, air ventilation or air dilution means for providing air to the smoking article and valve means operatively associated with the air ventilation means and adapted to move from a first position to a second position to substantially increase the concentration of air in the flow path of the smokestream with the depth of the smoker's draw and then return to the first position.

In a presently preferred embodiment of the invention, a cigarette is provided with a mouthpiece which may include a filter rod, and which further comprises the air ventilation means in the form of a rigid tube with perforations disposed circumferentially about the tube in one or more planes perpendicular to the axis of the cigarette. Within the rigid tube, a valve means is arranged to provide a flow path for the smokestream between the smoking material rod (tobacco in the described embodiment) and the tip of the mouthpiece. The valve means is in the form of a flexible tubular membrane secured at its ends to the inner wall of the rigid tube. In its relaxed, or zero pressure differential condition, the membrane has a sidewall forming a duct of continuously decreasing diameter from each end to the center thereof, similar in shape to a venturi tube. A plurality of vents, comprising longitudinal slits at the center of the flexible membrane preferably intersecting the aforesaid plane or planes of the air dilution perforations in the rigid tube, are normally closed when the membrane is in the relaxed position. The latter position is assumed when there is no suction on the mouthpiece tip, i.e., no pressure differential across the membrane.

However, when the smoker draws on the mouthpiece the flexible membrane is constricted by the pressure differential across it, and it therefore moves to a second, shrunk position with a smaller diameter. As a result, the slits therein are distended to admit ventilating air into the flow path of the smokesteam. There is no single second position of the membrane; rather, the membrane may be distorted or constricted to any of a multiplicity of positions in which the diameter of the flow path (duct) therethrough is successively decreased and the slits are increasingly opened. Thus, the smoker is able to vary the air dilution level of the cigarette at will by appropriately varying the depth of the draw which depth of draw corresponds to a given pressure differential across the membrane. Within limits, imposed for example by the material of which the membrane is composed, the greater the suction on the mouthpiece, the greater the quantity of ventilation air drawn into the flow path, and, hence, the greater the dilution level.

Accordingly, it is another object of the present invention to provide a smoking article in which the smokestream is variably diluted with ventilating air according to the depth of the smoker's draw on the mouthpiece.

It will be recognized that, uncharacteristically, the deeper the draw, the more the smokestream is diluted with ventilating air, while shallower puffs will increase the concentration of full-flavor smoke through the mouthpiece flow path.

Another object of the present invention is to provide a smoking article with a variable ventilation mouthpiece which provides a substantially unobstructed flow path for the smokestream, and thereby affords the smoker a smooth draw.

Yet another object of the present invention is to provide a smoking article with a variable ventilation mouthpiece which does not artificially limit the length of the smoker's puff.

BRIEF DESCRIPTION OF THE DRAWINGS

The above and still further objects, features and attendant advantages of the present invention will become apparent to those of ordinary skill in the field to which the invention pertains from a consideration of the following detailed description of the presently preferred embodiments, taken in conjunction with the accompanying drawings, in which.

DESCRIPTION OF THE PREFERRED EMBODIMENTS

Figure 1:
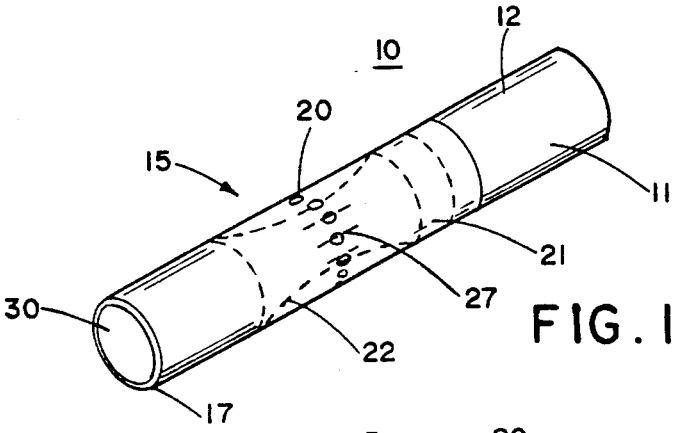
FIG. 1 is a partial perspective view, partly in phantom, of a cigarette incorporating a mouthpiece according to the presently preferred embodiment of the invention.
Figure 2:
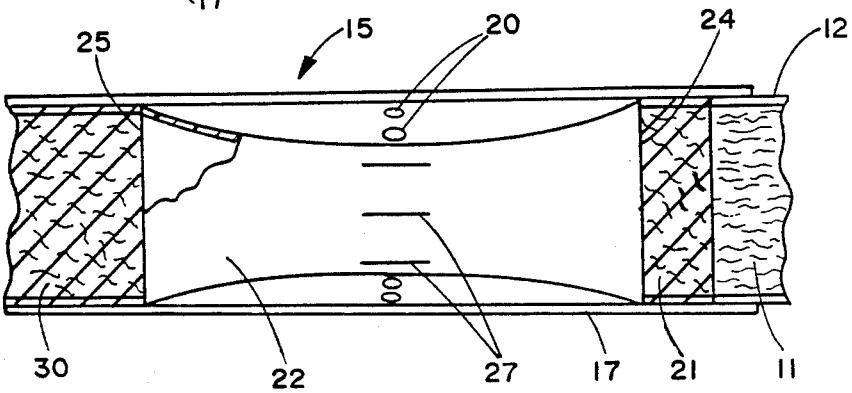
FIG. 2 is a partial sectional view of the cigarette of FIG. 1, taken through the longitudinal axis, showing the configuration of the mouthpiece including the air ventilation perforations and the flexible membrane with vents, for the relaxed position of the membrane in which no suction is applied to the mouthpiece tip.

Referring now to FIGS. 1 and 2, the presently preferred embodiment of the invention is depicted in a cigarette 10, only the relevant portion of which is shown in the drawings. Cigarette 10 includes a generally cylindrical rod 11 of smokable material contained in a wrapping material, such as cigarette paper 12, to which a mouthpiece 15 is affixed in any conventional manner. At the draw end of the mouthpiece 15 there is arranged a conventional fibrous filter 30 through which the smoker draws the smoke from the smokable material in rod 11. The rod 11 is referred to hereinafter as a "smokable rod" or a "tobacco rod" comprising tobacco or other smokable material, such as shredded pieces or strands of tobacco, processed tobacco, tobacco substitutes or blends thereof wrapped in cigarette paper to form a rod. Preferably, another fibrous filter 21 is positioned in the mouthpiece 15 at the end thereof abutting the tobacco rod 11 and in a plane perpendicular to the longitudinal axis of the cigarette. The filter 21 prevents tobacco particles from entering the mouthpiece and is also useful to extinguish the lit cigarette should it burn down to the mouthpiece as when allowed to burn out in an ashtray.

The mouthpiece 15 includes a rigid or resilient tube 17 of tipping paper, for example, which has a circumferentially aligned row of perforations 20 therein lying in a plane transverse to the longitudinal axis of the cigarette. The perforations, which are made in the course of manufacture of the cigarette either before or after assembly thereof, allow ambient ventilation air to enter the mouthpiece. Thus, in this embodiment the tipping paper 17 and perforations 20 constitute air ventilation or air dilution means for the cigarette. Of course, the smokestream which flows through the tobacco rod and the mouthpiece arises from suction as the smoker draws on the mouthpiece tip of the lighted cigarette, and thereby entrains air and smoke from the tobacco at the lit end. However, as used herein, the terminology "ventilation air,38 "dilution air," and words of similar import describe air which enters the flow path of the smokestream downstream from the lit end of the cigarette and which serves to dilute the smokestream. The magnitude of "air dilution" or "air ventilation" is defined as the ratio (generally expressed as a percentage) of the volume of air drawn through the air dilution or air ventilation means to the total volume of air and aerosol drawn through the smoking article and exiting the draw end of the smoking article.

Secured within the tube 17 of mouthpiece 15 is a flexible membrane 22 in the form of a tube or duct having a curved sidewall such that the diameter of the membrane duct continuously decreases from either end 24,25 to the center thereof in a manner similar to a venturi tube. Preferably, the membrane duct has a length at least twice the inner diameter of rigid tube 17. The ends 24,25 of membrane 22 are adhesively or otherwise sealingly attached about their circumference to the inner wall of the rigid tube. In the condition in which there is no suction on the mouthpiece tip, the membrane is in a relaxed position or state as shown in FIG. 2, with the portion between each circumferential fixed end free to move inwardly and outwardly toward and away from the longitudinal axis of the cigarette relative to the inner wall of the rigid tube. The membrane 22 may be composed of any suitable nontoxic flexible material, such as latex, polymeric film or paper.

In the central region of the membrane, that is, in the portion encompassing the smallest diameter of the duct, a plurality of longitudinal slits 27 is provided in a circumferential array in the side wall thereof. The slits may also be formed as flaps by cutting the membrane along a non-linear line or intersecting lines, e.g., a curved line or an intersecting pair of straight lines in a V-shape. The slits 27 are made prior to assembly of the mouthpiece, and are situated preferably to lie in close proximity to the perforations 20 in rigid tube 17 when the membrane is secured to the tube. In the normal, relaxed position of the membrane shown in FIG. 1, slits 27 are substantially closed.

Figure 3:
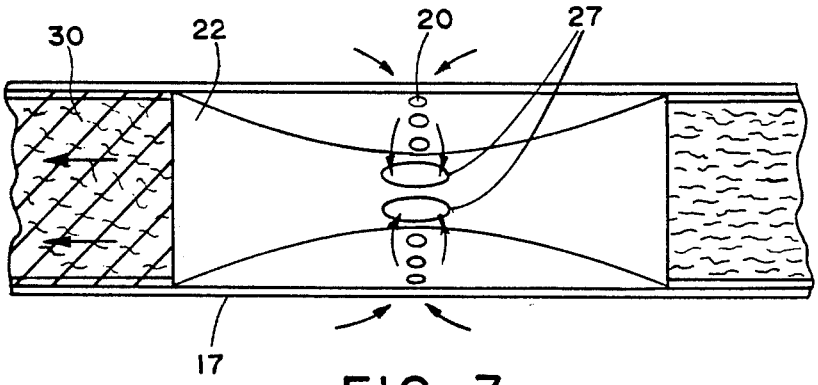
FIG. 3 is a view corresponding to that of FIG. 2, but in which suction is applied to the mouthpiece tip, as when the smoker draws on the cigarette, showing the constriction of the membrane and the consequent enlargement of the vents therein.

Referring now to FIG. 3, when the smoker draws on the mouthpiece tip, the suction creates a pressure differential across the sidewall of the membrane 22 thereby causing the sidewall to distort or shrink inwardly throughout its free length, and principally along the central region thereof, thus constricting the opening constituting the flow path for the smokestream. This, in turn, causes the slits 27 to distend and to act as vents for admitting ventilation air, which enters the cigarette mouthpiece via the perforations 20, into the flow path of the smokestream.

It will be observed that although the sidewall of the flexible membrane 22 forming the flow path in its portion of the mouthpiece is constricted in this activated position relative to the relaxed position shown in FIG. 2, there remains a substantial duct opening and, hence, there is no significant impediment to the smooth flow of the smokestream. This is quite different from the smoke control techniques and devices generally found in the prior art, where, apart from the filtering of the smoke by the tobacco itself and by any synthetic filters in the tip, solid obstructions often are interposed in the flow path which are impenetrable by the smokestream except via small holes therein. Such techniques and devices make it difficult for the smoker to achieve a smooth draw, with a consequent lessening of smoking enjoyment. The present invention has no such disadvantage.

Moreover, smoking articles according to the present invention produce no interruption, abrupt or otherwise, in the smoker's normal puff. The ventilation air introduced into the flow path via the perforations 20 and vents 27 serves to dilute the smokestream, but does not shorten the normal puff. In contrast, many of the prior art techniques and devices employ or operate as closure valves which produce a measured "puff" without regard to the smoking habits of the individual smoker, and thereby further lessen the smoking enjoyment.

It will be noted that the flexible membrane 22 together with its vents 27 serves as valve means in one sense, to control the dilution level of the smokestream with ventilating air. Within limits which are determined at least in part by the dimensions of the flexible membrane and the vents, and the material of which the membrane is composed, the greater the pressure differential across the wall of the membrane, the greater the distortion of the membrane and the enlargement of its vent openings. Accordingly, the smoker is able to control the dilution level of the smokestream at will by the depth of his or her draw, that is to say, by the degree of suction on the mouthpiece tip. Unlike many of the prior art devices for smoke control, the smoker need not draw deeply to achieve full-flavor smoke, and if he chooses to increase the length or depth of a puff the dilution level is increased.

Therefore, it will also be clear that the flexible membrane together with its vents serves as air ventilation means in combination with the tube and perforations therein, or as an adjunct to the air ventilation means.

While a presently preferred embodiment of the invention has been depicted and described herein, it is to be emphasized that this is by way of illustration only and that variations and modifications of the illustrative embodiment may be made by persons of ordinary skill in the field to which the invention pertains without departing from the spirit and scope of the inventive principles. For example, the number and location of the perforations in the tube and/or the slits in the membrane may be varied, as may the dimensions of the membrane relative to those of the mouthpiece or other components of the smoking article. Similarly, the invention is not restricted to use in cigarettes but may be advantageously employed in other smoking articles, including, for example, cigarette holders, pipes, and tipped cigars. Accordingly, the invention is to be limited only to the extent required by the appended claims and applicable rules of law.

What is claimed is:

1. A smoking article comprising in combination a smokable material, air ventilation means for providing air to the smoking article and valve means operatively associated with the air ventilation means and movable from a first position to a second position to increase the concentration of air in the puff flow stream according to the depth of each puff and then return substantially to the first position; said air ventilation means comprising a mouthpiece including a tube having perforations therein, and said valve means comprising a flexible tubular membrane attached at either end to the inner wall of said tube and having a sidewall with slits therein which are substantially closed in said first position and open in said second position to allow the entry of air into the puff flow stream via said perforations and open slits.

2. The smoking article of claim 1, wherein said flexible tubular membrane has a circular cross section which increases in diameter from the midpoint to each end thereof.

3. The smoking article of claim 2, wherein said air ventilation means comprises openings to admit air to the interior of the smoking article, and said valve means comprises vent means distensible in relation to the degree of suction applied to the smoking article by the smoker for introducing at least some of the admitted air into the smokestream.

4. A smoking article comprising in combination a smokable material, air ventilation means for providing air to the smoking article and valve means operatively associated with the air ventilation means and movable from a first position to a second position during each puff to deliver to the smoker a smokestream having a dilution level of air from the air ventilation means which increases in relation to the depth of the puff and then returns to the first position at the end of the puff; said air ventilation means comprising a mouthpiece including a tube having perforations therein, and said valve means comprising a flexible tubular membrane attached at either end to the inner wall of said tube and having a sidewall with slits therein which are substantially closed in said first position and open in said second position to allow the entry of air into the smokestream via said perforations and open slits.

5. The smoking article of claim 4, wherein said flexible tubular membrane has a circular cross section which increases in diameter front the midpoint to each end thereof.

6. A variable ventilation mouthpiece for a smoking article, comprising air ventilation means for varying the air dilution level of the smokestream of the smoking article according to the suction applied to the mouthpiece, said air ventilation means including first and second vent means at least one of which undergoes change from a closed to an open position upon application of suction to the mouthpiece; said first vent means including perforations in said mouthpiece, and said second vent means including a flexible membrane forming a duct for the smokestream having openings associated with said perforations, and (ii) of variable size according to the degree of suction applied to the mouthpiece.

7. The smoking article of claim 6, wherein said flexible tubular membrane has a circular cross section which increases in diameter from the midpoint to each end thereof.

* * * * *